US005503382A

United States Patent [19]

Hansen et al.

[11] Patent Number: 5,503,382

[45] Date of Patent: Apr. 2, 1996

[54] MISFEED DETECTOR FOR MULTI-TRAY AND INTERMEDIATE TRAY SHEET FEEDERS

[75] Inventors: Paul Hansen, Westminster; Sheldon F. Raizes, Palos Verdes; Michael D. Rumsey, Redondo Beach; William D. Barton, Rancho Palos Verdes; Keith Johnson, El Segundo, all of Calif.

[73] Assignee: Xerox Corporation, Stamford, Conn.

[21] Appl. No.: 387,672

[22] Filed: Feb. 13, 1995

[51] Int. Cl.[6] ..... B65H 5/22

[52] U.S. Cl. ..... 271/3.03; 271/3.13; 271/9.01; 271/9.05; 271/9.13; 271/263

[58] Field of Search ..... 271/9.01, 9.05, 271/9.13, 3.03, 3.13, 10.03, 110, 111, 258.01, 259, 262, 263, 265.04

[56] References Cited

U.S. PATENT DOCUMENTS

| | | | |
|---|---|---|---|
| 4,536,078 | 8/1985 | Ziehm | 271/3.03 |
| 4,651,982 | 3/1987 | Martin | 271/263 |
| 4,881,104 | 11/1989 | Kusumoto et al. | 271/9.05 |
| 5,110,114 | 5/1992 | Yamauchi et al. | 271/263 |
| 5,114,138 | 5/1992 | Ichinose | 271/263 |
| 5,135,114 | 8/1992 | Satake et al. | 209/588 |

FOREIGN PATENT DOCUMENTS

| | | | |
|---|---|---|---|
| 0195105 | 9/1986 | European Pat. Off. | 271/262 |
| 62-116441 | 5/1987 | Japan | 271/263 |
| 0117542 | 5/1990 | Japan | 271/262 |
| 0144353 | 6/1990 | Japan | 271/262 |

*Primary Examiner*—H. Grant Skaggs
*Attorney, Agent, or Firm*—Sheldon Raizes

[57] ABSTRACT

The thickness of a first sheet fed from each tray of the multi-tray sheet feeder is detected by a first sensor and a thickness value is placed in memory for that tray. Each sheet subsequently fed from the same tray is detected by the same sensor and the thickness value sensed is placed in memory and compared with the thickness value in memory for that tray. When a tray is reloaded, the thickness value in memory for the sheets previously loaded in the tray is erased and the first sheet fed from the reloaded tray is sensed and a thickness value for that sheet is placed in memory for the reloaded tray. After the thickness value of a sheet is sensed by the first sensor, the sheets enter into the intermediate tray. The thickness value of a sheet is detected by an outlet sensor as it leaves the intermediate sheet tray and that value is compared to the thickness value in memory which was detected for the same sheet by the first sensor. During the comparison steps, if the values match, then only one sheet has passed through a sensor. If the thickness value sensed is more that the thickness value in memory, then that indicates that more than one sheet has passed through the sensor and the system is shut down to enable an operator to correct the situation or the offending sheets can be sent to a purge tray at the printer without shutting down the system.

20 Claims, 3 Drawing Sheets

MISFEED DETECTOR FOR MULTI-TRAY AND INTERMEDIATE TRAY SHEET FEEDERS

BACKGROUND

This invention relates to a system for detecting a multi-sheet feed from multi-tray sheet feeders and from an intermediate or buffer sheet stacker or tray which receives sheets from the multi-tray sheet feeders.

It is common to employ a multi-tray sheet feeder with laser printers. The sheets are fed from the multi-tray sheet feeder to an intermediate or buffer sheet tray and then fed into the printer from the intermediate or buffer sheet tray. It is important that only one sheet at a time be fed from the multi-tray sheet feeder and from the intermediate tray and if more than one sheet is fed from the multi-tray sheet feeder or from the intermediate tray, that it be detected immediately and the system be shut down to correct the situation or the offending sheets can be sent to a purge tray at the printer without shutting down the system. The sheets in one tray of the multi-tray sheet feeder may be of a thickness which is different than the thickness of the sheets in another tray of the multi-tray sheet feeder and therefore, the intermediate tray can contain sheets of different thicknesses. Therefore, there must be a way of detecting a double sheet feed of sheets of the same thickness from each of the multi-tray sheet feeders and a way of detecting a double sheet feed from the intermediate tray which can contain sheets of various thicknesses.

SUMMARY OF INVENTION

In accordance with this invention, the thickness of the first sheet fed from each tray of the multi-tray sheet feeder is detected by a first sensor and a thickness value is placed in memory for that tray;. Each sheet subsequently fed from the same tray is detected by the same sensor and the thickness value sensed is placed in memory and compared with the thickness value in memory for that tray. If the values match, then only one sheet has been fed from the tray. If the thickness value is more than the thickness value in memory for that tray, then that indicates that more than one sheet has just left the tray and the system is shut down to enable an operator to correct the situation. When a tray is reloaded, the thickness value in memory for the sheets previously loaded in the tray is erased and the first sheet fed from the reloaded tray is sensed and a thickness value for that sheet is placed in memory for the reloaded tray.

After the thickness value of a sheet is sensed by the first sensor, the sheets enter into the intermediate tray. The thickness value of a sheet is detected by an outlet sensor as it leaves the intermediate sheet tray and that value is compared to the thickness value in memory which was detected for the same sheet by the first sensor. If the values match, then only one sheet has been fed from the intermediate tray. If the thickness value of the sheet as it leaves the intermediate tray is more than the thickness value in memory, then that indicates that more than one sheet has just left the intermediate tray and the system is shut down to enable an operator to correct the situation or the offending sheets can be sent to a purge tray at the printer without shutting down the system.

DETAILED DESCRIPTION OF PREFERRED EMBODIMENT

Figure 1:
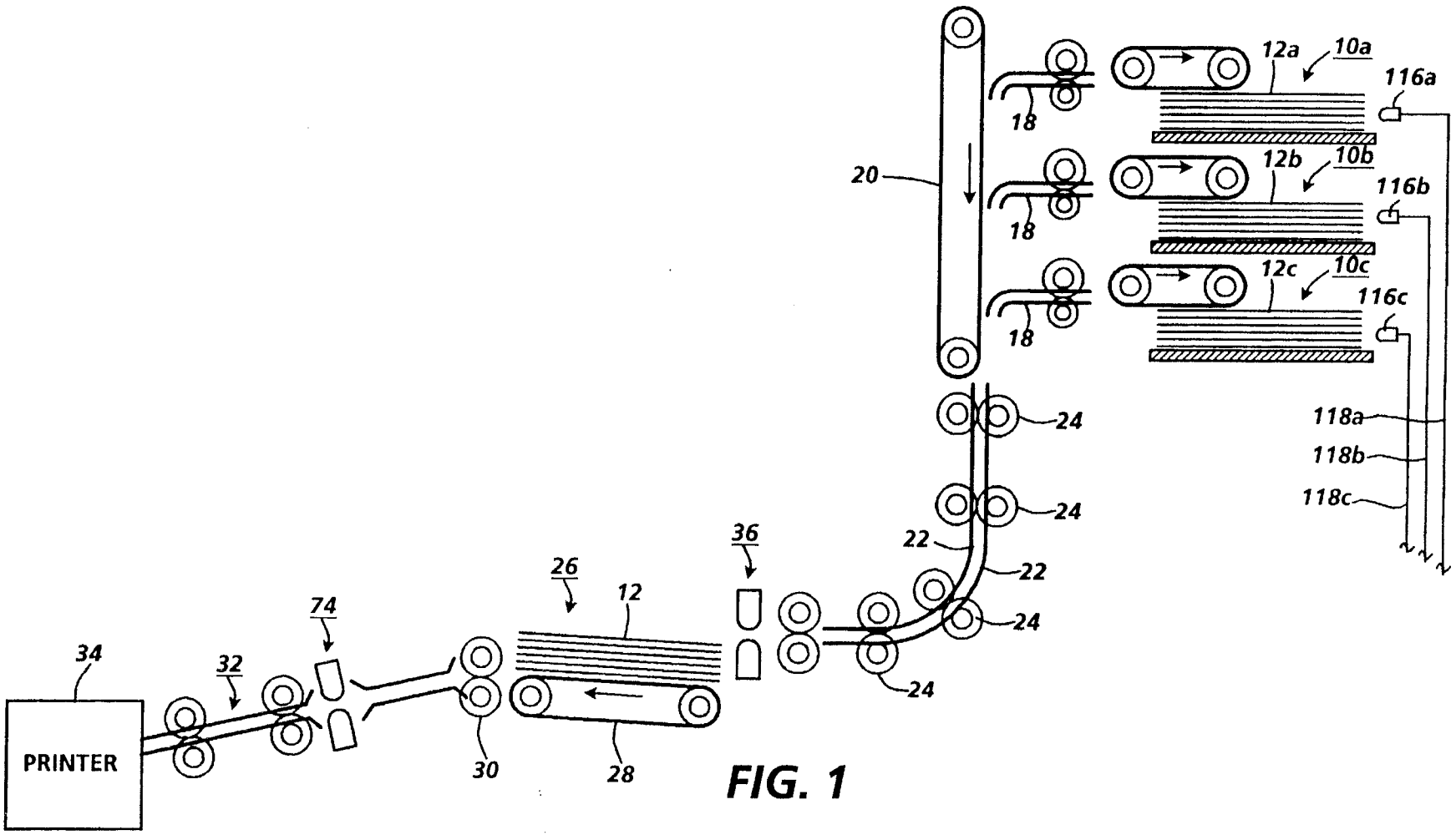
FIG. 1 is a schematic view of a printing system which includes the multi-sheet feed detectors of this invention.

Referring to FIG. 1, there is shown a printing system comprising three feed trays 10*a*, 10*b*, and 10*c*, each having a plurality of sheets 12*a*, 12*b*, and 12*c*, respectively, stacked therein. The sheets in each tray are of the same thickness as the others in the same tray, but may be either a different thickness than the sheets in one or more of the other trays or the same thickness as the sheets in one or more of the other trays. A sheet feeding apparatus 18 is provided for each feed tray and a common vacuum sheet transport belt conveyor 20 transports a sheet to guides 22 where a plurality of driven nip rolls 24 move a sheet through the guides to an intermediate stacker or tray 26. Sheets are bottom fed from the stacker 26 by a vacuum transport belt 28 to nip rolls 30 which move the sheets to a printer entry transport 32 from which the sheets enter a laser printer 34 where an image is transferred to each sheet.

Figure 2:
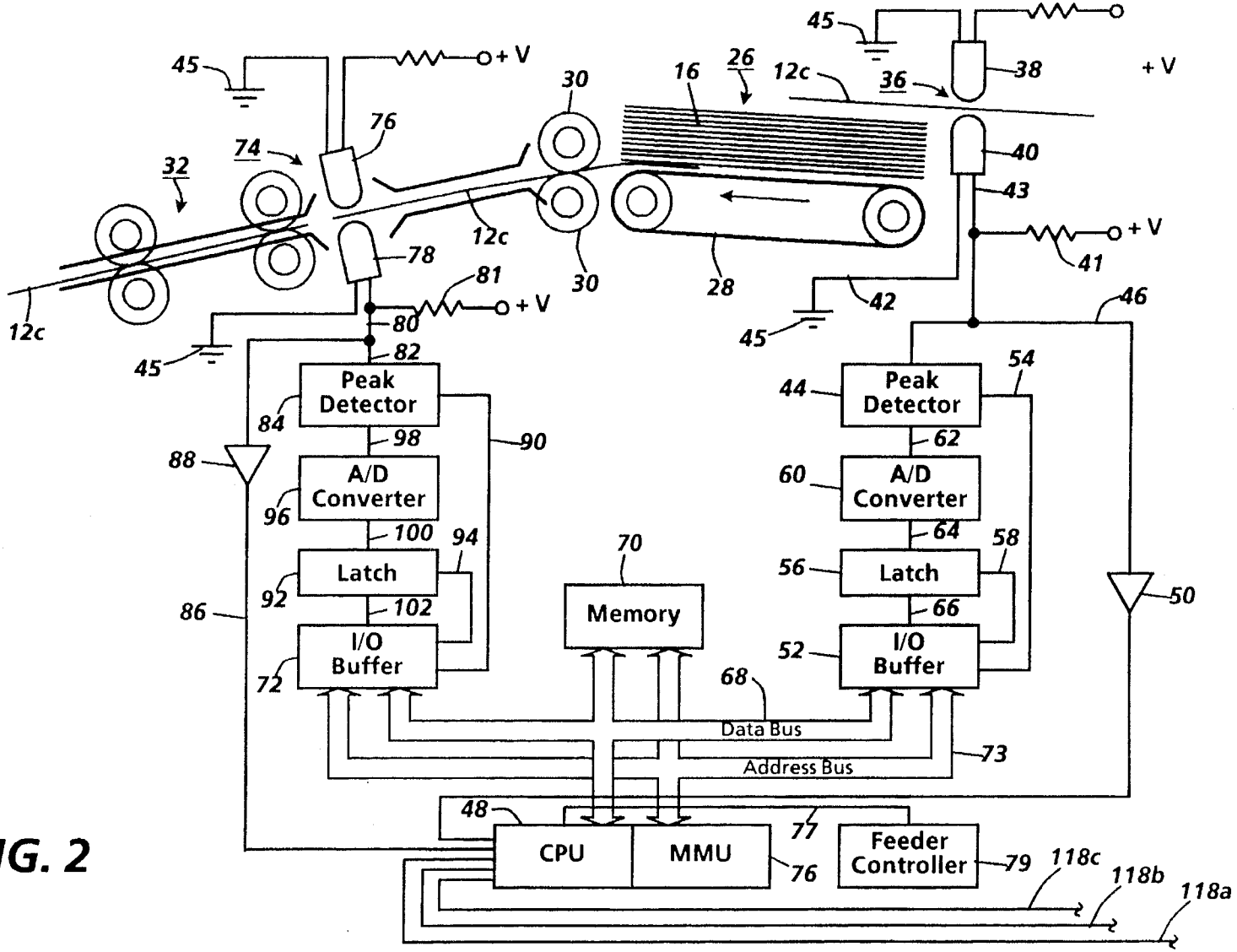
FIG. 2 is a block schematic diagram of the multi-sheet feed detectors operating system illustrated in FIG. 1.

Referring to FIG. 2, there is shown the intermediate sheet stacker 26 and a schematic of a sheet thickness sensing arrangement. A sensor 36 is provided at the inlet of the stacker 26 and ;comprises an infrared emitter 38 and a phototransistor 40. The collector 43 of the phototransistor 40 is connected through a control line 42 to a peak detector 44 and through control line 46 to a CPU (central processing unit) 48. A positive transition detector 50 is located in control line 46 between the phototransistor 40 and the CPU 48 and detects sudden voltage changes at the collector 43. The peak detector 44 detects a peak voltage at collector 43 and is connected to an I/O (input/output) buffer 52 through a control line 54 to allow the CPU to reset the peak detector to zero. A latch 56 is connected to the I/O buffer 52 through a control line 58 to allow the CPU to implement a data latch function. An A/D (analog/digital) converter 60 is connected to the peak detector 44 by line 62 and to the latch 56 by a 10 bit data line 64. A 10 bit data line 66 connects the latch 56 to the I/O buffer 52. A 16 bit data bus 68 links the CPU 48 with the I/O buffer 52, memory 70 and another I/O buffer 72. An address bus 73 links a MMU (memory management unit) 76 with the I/O buffers 52 and 72 and the memory 70.

The memory 70 is a two-part memory having a RAM and an EPROM. The EPROM contains a program for controlling measurement and storage of thickness values of the sheets 12*a*, 12*b*, and 12*c* arriving at the sensor 36 from the trays 10*a*, 10*b*, and 10*c* and arriving at an outlet sensor 74 from the intermediate stacker 26 and for comparison of the thickness values for detecting double sheet feed from the trays 10*a*, 10*b*, 10*c* and the intermediate stacker 26. The CPU 48 is connected through a control line 77 to a feeder controller 79 for controlling feeding of the sheets from the trays 10*a*, 10*b*, and 10*c* and into and out of the intermediate stacker 26.

At the outlet of the intermediate stacker 26 is the outlet sensor 74 which comprises an infrared emitter 76 and a phototransistor 78 with a collector 80. The collector 80 of the phototransistor 78 is connected through a control line 82 to a peak detector 84 and through control line 86 to the CPU 48. A positive transition detector 88 is located in control line 86 between the phototransistor 78 and the CPU 48 and detects sudden voltage changes at the collector 80. The peak detector 84 detects a peak voltage at collector 80 and is connected to the I/O buffer 72 through a control line 90 to allow the CPU to reset the peak detector to zero. A latch 92 is connected to the I/O buffer 72 through a control line 94 to allow the CPU to implement a data latch function. An A/D converter 96 is connected to the peak detector 84 by line 98 and to the latch 92 by a 10 bit data line 100. A 10 bit data line 102 connects the latch 92 to the I/O buffer 72.

The amount of current that flows through the phototransistors 40, 78 is a function of the amount of light to which a phototransistor is exposed. If the exposure to light is increased, more current will flow and if the exposure to light is decreased, less current will flow. The emitters 38 and 76 each emits rays towards the base of its respective phototransistor 40 and 78 and strikes the phototransistors 40, 78 at maximum intensity when a sheet of paper is not between the emitter and its respective phototransistor. Therefore, there is maximum current flow across a resistor 41 when a sheet of paper is not between emitter 38 and its respective phototransistor 40 and the voltage difference between ground and the collector 43 of the phototransistor 40 is at its lowest value in this condition. It also follows that there is maximum current flow across a resistor 81 when a sheet of paper is not between emitter 76 and its respective phototransistor 98 and the voltage difference between ground and the collector 80 of the phototransistor 78 is at its lowest value in this condition.

When a sheet of paper passes between the emitter 38 and the phototransistor 40, light from the emitter will pass through the sheet of paper with the amount of light passing through being dependent upon the thickness of the paper. More light will pass through a thin sheet than a thick sheet. Since the phototransistor 40 is exposed to less light when a sheet of paper is passing between the emitter 38 and the phototransistor 40, less current flows across resistor 41 and the voltage difference between the collector 43 and ground 45 increases. The voltage difference between ground 45 and the collector 41 will increase in accordance with an increase in the thickness of a sheet since the amount of light to which the phototransistor 40 is exposed decreases as the thickness of a sheet sensed increases. This principle also applies when a sheet of paper passes between the emitter 76 and the phototransistor 98 and therefore the voltage difference between ground 45 and the collecter 80 will increase in accordance with an increase in the thickness of a sheet.

Figure 3:
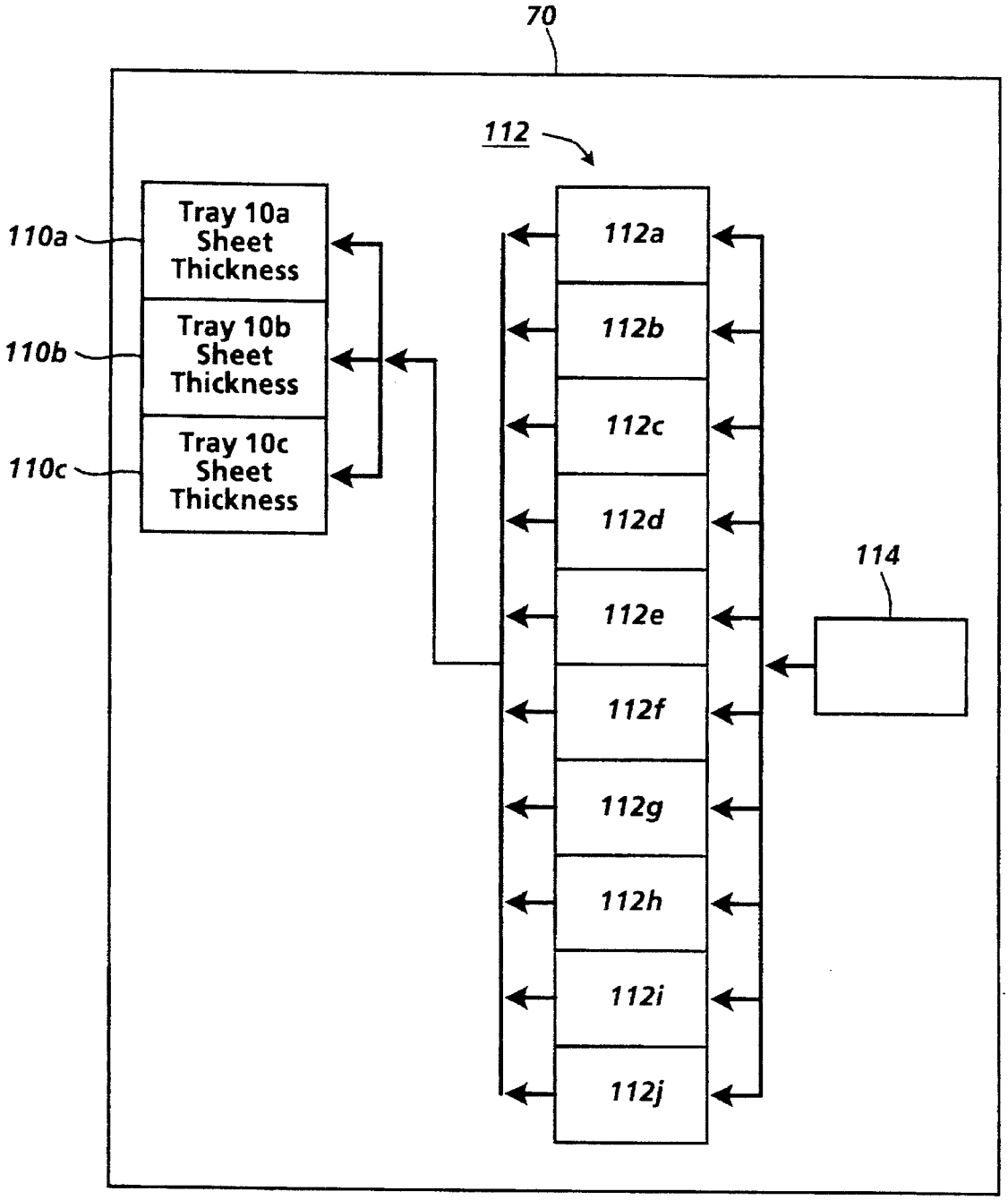
FIG. 3 is a block schematic diagram of a portion of a RAM memory of the schematic of FIG. 2.

The Ram section of the memory 70 is shown in FIG. 3. There are three memory groups 110*a*, 110*b* and 110*c* for the thickness value of the sheets in each tray 10*a*, 10*b*, and 10*c*, respectively. The sensed thickness value of the first sheet fed from a particular tray is put into one of these groups for the particular tray from which a first sheet is fed. Temporary memory groups 112 are provided for storage of the thickness values sensed by the sensor 36. The number of groups 112 will be at least equal to the sheet capacity of the intermediate stacker. Ten groups, 112*a* through 112*j* are shown for illustrative purposes only. There is also a temporary memory group 114 for storage of the thickness values sensed by the outlet sensor 74. Each memory group contains a plurality of memory locations, depending upon the number of samplings taken during sensing of a sheet.

Each tray 10*a*, 10*b*, and 10*c* has a tray sensor 116*a*, 116*b*, and 116*c* connected thereto for sensing when its respective tray has been lowered for refilling. The tray sensors 116*a*, 116*b*, and 116*c* are communicated to the CPU 48 by control lines 118*a*, 118*b*, and 118*c*, respectively. The tray sensor may be a contact switch, a push button switch or any other well known sensing device. When a tray is lowered, the tray sensor causes an interrupt through a respective control line at the CPU 48. The CPU 48 is programmed to respond to the interrupt to clear the memory for the tray that has been lowered and start the program for placing in the appropriate memory location for that tray the thickness value of the first sheet sensed that is fed from that tray after it is reloaded.

In operation, when a sheet is introduced into the sensor 36, there will be a sudden voltage change at the collector 43 which is sensed by the positive transition detector 50 which causes an interrupt through the control line 46 at CPU 48. The CPU is programmed to only respond to the initial interrupt and ignore any subsequent interrupts until after the sheet of paper has left the sensor 36. In response to the initial interrupt, the CPU, in conjunction with the MMU 76, addresses the I/O buffer 52 which immediately resets the peak detector 44. The voltage at collector 43 can be sampled only once per sheet or a plurality of times as the sheet passes through the sensor. Sampling the sheet thickness once has a drawback if the sheet has a hole in it, has an opaque portion or, if it is a preprinted form, has light and dark printing on it, since, if any of these are sensed, an incorrect reading of the thickness of a sheet will occur. Therefore it is desirable to sample the thickness of the sheet at more than one location. For example, the sheet can be sampled six times as the sheet passes through the;sensor 36. Assuming that the sheet is 8½×11 inches and the 11 inch edge is the leading edge into the sensor 36, and the sheet passes across the sensor 36 at a speed of 65 inches per second, each sheet section sensed before sampling will be 1.4 inches and sampling will occur every 22 milliseconds.

The peak detector senses the voltage at collector 43 as the sheet passes between the emitter 38 and the phototransistor 40 with this voltage representing the thickness of the sheet. The voltage at the peak detector 44 is inputted to the A/D converter 60 in analog form and this is converted to digital form by the A/D converter 60 and sent to the latch 56. The first sensing will be completed by a first sampling taken 22 milliseconds after entry of the sheet into the sensor 36. The latch will be set at 22 milliseconds to capture the peak voltage in peak detector 44 and the peak detector reset immediately thereafter for detecting the voltage over the next 1.4 inches of the sheet. Some time between the expiration of the first 22 milliseconds and the expiration of the next 22 milliseconds, the I/O buffer 52 will send the voltage information for the first sampling of the sheet to the memory 70. The same cycle is repeated until after the sixth 1.4 inch section is sampled. When a new sheet is introduced into the sensor 36, the sudden voltage change at the collector 43 is sensed by the positive transition detector 50 which causes an interrupt at the CPU 48 and the same cycle is repeated for the new sheet.

If the sheet that is introduced into the sensor 36 is the first sheet to be fed from one of the trays 10*a*, 10*b*, 10*c*, then the six thickness values sensed by the sensor 36 will be placed in the memory group for that tray, i.e., 110*a*, 110*b*, or 110*c*. The thickness values for the first sheet will also be placed in one of the memory groups 112 for thickness values sensed by the sensor 36 in accordance with a queue position in which it is introduced into the sensor 36. For instance, if the first sheet 12*a* that is fed from the tray 10*a* is the fifth sheet to be introduced into the sensor 36, then the thickness values sensed will be placed in memory group 110*a* and in memory group 112*e*. If the sheet introduced into the sensor 36 is not the first sheet from a tray, then the thickness values of that sheet sensed by the sensor 36 will be compared with the thickness values in the memory group corresponding to the tray from which the sheet was fed. For example, if a sheet 12*c* from tray 10*c* is introduced into the sensor 36 and there are already six sheets in the intermediate tray 26, then the thickness values sensed will be placed in the seventh memory group 112*g* and the thickness values in memory group 112*g* will be compared with the thickness values for the sheets in tray 10*c* which reside in memory group 110*c*.

Utilizing the last example for illustrative purposes, the sum of the six sensed values in memory group 112*g* is compared with the sum of the six sensed values in memory group 110*c*. If the sums are within a chosen tolerance of each other, it will be assumed that only one sheet 12*c* has passed through the sensor 36 and normal operation of the printing system will continue. If the sum of the six sensed values which are located in memory group 112*g* is less than the sum of the six sensed values located in memory group 110*c* by more than a chosen tolerance, then such will indicate a greater sheet thickness for the sheet 12*c* passing through the sensor 36 than the thickness stored for the sheets 12*c* in tray 10*c*. Thus, it will be assumed that more than one sheet has passed through the sensor 36 and a signal will be sent by the CPU 48 over the control line 77 to the feeder controller 79 to immediately stop the sheet feeding system for at least the trays 10*a*, 10*b*, and 10*c*. The sheet feeding system for the intermediate tray 26 can also be immediately stopped. However, since the multi-sheet feed has been detected upstream of the intermediate tray 26, it may be desirable to allow continued feeding of sheets from that tray 26 to a printer until the tray is depleted instead of immediately stopping the feeding from that tray. This will depend upon the system design. A system operator can then remove the double fed sheets and reset the system to resume normal operation. Alternatively, a signal can cause the offending sheets to be sent to a purge tray at the printer without stopping the sheet feeding system.

When a sheet is fed from the intermediate sheet stacker 26 and introduced into the ,outlet sensor 74, there will be a sudden voltage change at the collector 80 which is sensed by the positive transition detector 88 which causes an interrupt through the control line 86 at the CPU 48. The CPU is programmed to only respond to the initial interrupt and ignore any subsequent interrupts until after the sheet of paper has left the sensor 74. In response to the initial interrupt, the CPU, in conjunction with the MMU 76, addresses the I/O buffer 72 which immediately resets the peak detector 84. The voltage at collector 80 is sampled the same number of times as the voltage at collector 43 is sampled. The sheet passes across the outlet sensor 74 at approximately ½ the speed that the sheet passes through the inlet sensor 36. Therefore, each sheet section sensed before sampling will be 1.4 inches and sampling will occur every 44 milliseconds.

The peak detector 84 senses the voltage at collector 80 as the sheet passes between the emitter 76 and the phototransistor 78 with this voltage representing the thickness of the sheet. The voltage at the peak detector 84 is inputted to the A/D converter 96 in analog form and this is converted to digital form by the A/D converter 96 and sent to the latch 92. The first sensing will be completed by a first sampling taken 44 milliseconds after entry of the sheet into the sensor 74. The latch will be set at 44 milliseconds to capture the peak voltage in peak detector 84 and the peak detector is reset immediately thereafter for detecting the voltage over the next 1.4 inches of the sheet. Some time between the expiration of the first 44 milliseconds and the expiration of the next 44 milliseconds, the I/O buffer 72 will send the voltage information for the first sampling of the sheet to the memory 70. The same cycle is repeated until after the sixth 1.4 inch section is sampled. When a new sheet is introduced into the sensor 74, the sudden voltage change at the collector 80 is sensed by the positive transition detector 88 which causes an interrupt at the CPU 48 and the same cycle is repeated for the new sheet. After the sixth 1.4 inch section of a sheet is sampled while the sheet passes through outlet sensor 74, the six sampled values of the same sheet as it passed through the sensor 36 are compared with the six sampled values of the sheet as it passed through the outlet sensor 74.

In order to know which sheet is entering the intermediate outlet sensor 74, a first in, first out system is set up. If a plurality of sheets are introduced into the intermediate stacker after passing through the sensor 36, the first sheet into the stacker will be the first sheet out of the stacker since the vacuum transport belt 28 is at the bottom of the stacker and feeds sheets to the outlet sensor 74 from the bottom of the stack of sheets 26.

For illustrative purposes and using the same sheet 12*c* from the previous example, the thickness values for the sheet sensed by the outlet sensor 74 will be placed in memory group 114 for thickness values sensed by the sensor 74. The thickness values in memory group 114 will be compared with the thickness values in memory group 112*g* which contains the thickness values sensed by sensor 36 for the same sheet when it entered the intermediate sheet stacker 26. This can be achieved by comparing the sum of the six sensed values in memory group 114 with the sum of the six sensed values in memory group 112*g*. If the sums are within a chosen tolerance of each other, it will be assumed that only one sheet has passed through the outlet sensor 74 and normal operation of the printing system will continue. If the sum of the six sensed values in memory group 114 is lower than the sum of the six sensed values in memory group 112*g* by more than a chosen tolerance, then such will indicate a greater sheet thickness at the outlet sensor 74 than at the sensor 36 for the same sheet. Thus, it will be assumed that more than one sheet has passed through the outlet sensor 74 and a signal will be sent by the CPU 48 over the control line 77 to the feeder controller 79 to immediately stop the sheet feeding system for trays 10*a*, 10*b*, 10*c*, and 26. A system operator can then remove the double fed sheets and any other affected sheets and reset the system to resume normal operation. Alternatively, in response to the signal, the offending sheets can be sent to a purge tray at the printer without Stopping the sheet feeding system.

The comparison functions can be conducted as a new sheet is fed into the sensors 36 and 74. This way, the system is not held up while a comparison is being made. Also, instead of comparing sums of values, each value sampled at the inlet sensor 34 can be compared with each corresponding value sampled at the outlet sensor 74. If a certain number of values match within a given tolerance, it will be assumed that only one sheet passed through the outlet sensor 74. For instance, if four of the six sensed values match, it will be assumed that only one sheet passed through the outlet sensor 74. Obviously, other ways of comparing values can be used and the number of samplings can be changed to a particular situation desired.

The detect system can also be used to detect a sheet which is being fed out of turn as well as double fed sheets. This is accomplished by having the CPU 48 send a signal at any time the thickness values compared differ from one another above a chosen tolerance instead of only sending a signal when the value at the outlet sensor 74 is lower than a tolerance value at the inlet sensor 36. Thus the system will catch a sheet that is not as thick as the sheet that is scheduled to exit the intermediate stacker. This can happen if a double sheet feed is missed.

It should be realized that sensors other than that disclosed can be used to sense the thickness of a sheet. For instance, a capacitance sensor can be used or a mechanical sensor can be used where movement of an arm in contact with a sheet passing beneath the arm is translated into a sheet thickness value.

From the above, it can be seen that the system described will be able to ascertain a misfeed of sheets from multi-tray sheet feeders and from an intermediate tray of sheets of variable weights. Also, the system described can be applicable to a single tray feeder with an intermediate stacker.

The system and the electronic components thereof have been described in general. It should be realized that well known programming techniques and off-the-shelf hardware are all that are required to achieve the principles of this invention. Thus someone with ordinary skill in the art will be able to construct the system described.

We claim:

1. In a sheet transport system comprising:

a. a first sheet support tray for supporting a stack of sheets, b. a second sheet support tray for supporting a stack of sheets, c. first guide means operably connected to said first and second sheet support trays and located to receive sheets from each of said first and second sheet support trays, d. a first sensor at said first guide means for sensing the thickness of each sheet passing through said first guide means, e. said first sensor being at a location to receive sheets from each of said first and second support trays, f. a third sheet support tray being operably connected to said first guide means for receiving sheets from said first and second sheet support trays after the sheets pass through said first sensor, g. second guide means operably connected to said third sheet support tray for receiving sheets therefrom, h. a second sensor at said second guide means for sensing the thickness of each sheet passing through said second guide means from said third sheet support tray, i. means for storing in memory the thickness value sensed by said first sensor of a first sheet fed from each of said first and second sheet support trays and passing through said first guide means, j. means for storing in memory a thickness value sensed by said first sensor of subsequent sheets fed from each of said first and second sheet support trays and comparing that value with the thickness value stored in memory of the first sheet fed from the same tray and generating a signal indicating a misfeed if the values differ by a predetermined amount, and k. means for comparing the thickness value sensed by said second sensor of sheets fed from said third sheet support tray with the thickness value in memory which was sensed by said first sensor of the same sheet and generating a signal indicating a misfeed if the values differ by a predetermined amount.

2. In a sheet transport system recited in claim 1 further comprising means for feeding sheets from each of said first and second sheet support trays to said first guide means, and means responsive to said first named signal for making inoperative said sheet feeding means.

3. In a sheet transport system recited in claim 1 further comprising means for feeding sheets from each of said first and second sheet support trays to said first guide means and from said third sheet support tray to said second guide means, and means responsive to said first named signal for making inoperative at least said means for feeding sheets from each of said first and second sheet support trays and means responsive to said second named signal for making inoperative said means for feeding sheets from each of said first, second and third sheet support trays.

4. In a sheet transport system recited in claim 1 wherein each sensor comprises an infrared emitter located on one side of a sheet passing through the sensor and a phototransistor located on the opposite side of a sheet passing through the sensor and arranged to receive rays emitted by said infrared emitter.

5. In a sheet transport system recited in claim 4, wherein each phototransistor has a collector referenced to ground and the sheet thickness value is sensed by each sensor by detecting the potential between ground and its collector as a sheet passes between said infrared emitter and said phototransistor of each sensor.

6. In a sheet transport system recited in claim 1 further comprising means for keeping track of a sheet after it passes through said first sensor until it passes through said second sensor.

7. In a sheet transport system recited in claim 1 wherein the value of the thickness of a sheet sensed at said second sensor is stored in memory and such thickness value in memory is the thickness value sensed by said second sensor of sheets fed from said third sheet support tray which is compared with the thickness value in memory which was sensed by said first sensor of the same sheet.

8. In a sheet transport system recited in claim 1 wherein said first and second sheet support trays each support a stack of sheets and the sheets on said first sheet support tray are a thickness which is different than the thickness of the sheets on said second sheet support tray.

9. In a sheet transport system comprising:

a first sheet support tray for supporting a stack of sheets, a second sheet support tray for supporting a stack of sheets, c. first guide means operably connected to said first and second sheet support trays and located to receive sheets from each of said first and second sheet support trays, d. a first sensor at said first guide means for sensing the thickness of each sheet passing through said first guide means, e. said first sensor being at a location to receive sheets from each of said first and second support trays, f. a third sheet support tray being operably connected to said first guide means for receiving sheets from said first and second sheet support trays after the sheets pass through said first sensor, g. second guide means operably connected to said third sheet support tray for receiving sheets therefrom, h. a second sensor at said second guide means for sensing the thickness of each sheet passing through said second guide means from said third sheet support tray, i. means for selectively feeding sheets from each of said first and second sheet support trays to said third sheet support tray, means for feeding sheets from said third support tray to said second guide means, k. means for keeping track of a sheet after it passes through said first sensor until it passes through said second sensor, l. means for storing in memory the thickness value sensed by said first sensor of a first sheet fed from each of said first and second sheet support trays and passing through said first guide means, m. means for storing in memory a thickness value sensed by said first sensor of subsequent sheets fed from each of said first and second sheet support trays and comparing that value with the thickness value stored in memory of the first sheet fed from the same tray and generating a signal indicating a misfeed if the values differ by a predetermined amount, and n. means for storing in memory a thickness value sensed by said second sensor and comparing that value with the thickness value in memory which was sensed by said first sensor of the same sheet and generating a signal indicating a misfeed if the values differ by a predetermined amount.

10. In a sheet transport system recited in claim 9 further comprising means responsive to the first named signal for making inoperative at least said means for selectively feeding sheets from each of said first and second sheet support trays to said third sheet support tray and means responsive to the second named signal for making inoperative said means for selectively feeding sheets from each of said first and second sheet support trays and said means for feeding sheets from said third sheet support tray.

11. In a sheet transport system recited in claim 9 wherein each sensor comprises an infrared emitter located on one side of a sheet passing through the sensor and a phototransistor located on the opposite side of a sheet passing through the sensor and arranged to receive rays emitted by said infrared emitter.

12. In a sheet transport system recited in claim 10, wherein each phototransistor has a collector referenced to ground and the sheet thickness value is sensed by each sensor by detecting the potential between ground and its collector as a sheet passes between said infrared emitter and said phototransistor of each sensor.

13. In a sheet transport system recited in claim 9 wherein said first and second sheet support trays each support a stack of sheets and the sheets on said first sheet support tray are a thickness which is different than the thickness of the sheets on said second sheet support tray.

14. In a sheet transport system comprising:

a. a first sheet support tray for supporting a stack of sheets, b. first guide means operably connected to said first sheet support tray and located to receive sheets from said first sheet support tray, c. a first sensor at said first guide means for sensing the thickness of each sheet passing through said first guide means, d. said first sensor being at a location to receive sheets from said first support tray, e. a second sheet support tray being operably connected to said first guide means for receiving sheets from said first sheet support tray after the sheets pass through said first sensor, f. second guide means operably connected to said second sheet support tray for receiving sheets therefrom, g. a second sensor at said second guide means for sensing the thickness of each sheet passing through said second guide means from said second sheet support tray, h. means for storing in memory the thickness value sensed by said first sensor of a first sheet fed from said first sheet support tray and passing through said first guide means, i. means for storing in memory a thickness value sensed by said first sensor of subsequent sheets fed from said first sheet support tray and comparing that value with the thickness value stored in memory of the first sheet fed from said first sheet support tray and generating a signal indicating a misfeed if the values differ by a predetermined amount, and j. means for comparing the thickness value sensed by said second sensor of sheets fed from said second sheet support tray with the thickness value in memory which was sensed by said first sensor of the same sheet and generating a signal indicating a misfeed if the values differ by a predetermined amount.

15. In a sheet transport system recited in claim 14 further comprising means for feeding sheets from said first sheet support tray to said first guide means, and means responsive to said first named signal for making inoperative said sheet feeding means.

16. In a sheet transport system recited in claim 14 further comprising means for feeding sheets from said first sheet support tray to said first guide means and from said second sheet support tray to said second guide means, and means responsive to said first named signal for making inoperative at least said means for feeding sheets from said first sheet support tray and means responsive to said second named signal for making inoperative said means for feeding sheets from each of said first and second sheet support trays.

17. In a sheet transport system recited in claim 14 wherein each sensor comprises an infrared emitter located on one side of a sheet passing through the sensor and a phototransistor located on the opposite side of a sheet passing through the sensor and arranged to receive rays emitted by said infrared emitter.

18. In a sheet transport system recited in claim 14, wherein each phototransistor has a collector referenced to ground and the sheet thickness value is sensed by each sensor by detecting the potential between ground and its collector as a sheet passes between said infrared emitter and said phototransistor of each sensor.

19. In a sheet transport system recited in claim 14 further comprising means for keeping track of a sheet after it passes through said first sensor until it passes through said second sensor.

20. In a sheet transport system recited in claim 14 wherein the value of the thickness of a sheet sensed at said second sensor is stored in memory and such thickness value in memory is the thickness value sensed by said second sensor of sheets fed from said second sheet support tray which is compared with the thickness value in memory which was sensed by said first sensor of the same sheet.

* * * * *

UNITED STATES PATENT AND TRADEMARK OFFICE

CERTIFICATE OF CORRECTION

PATENT NO. : 5,503,382

DATED : April 2, 1996

INVENTOR(S) : Hansen et al

It is certified that error appears in the above--identified patent and that said Letters Patent is hereby corrected as shown below: On the title page: Item [75]

Under "Inventors", please correct the spelling of "William D. Barton" to --William D. Bartron--.

Signed and Sealed this

Twenty-seventh Day of August, 1996

*Attest:*

Bruce Lehman

BRUCE LEHMAN

*Attesting Officer*

*Commissioner of Patents and Trademarks*